US007269925B2

(12) United States Patent
Lam

(10) Patent No.: US 7,269,925 B2
(45) **Date of Patent: *Sep. 18, 2007**

(54) LAYOUT OF PRODUCTION FACILITY

(76) Inventor: Wei Chak Joseph Lam, 9H Yuan Ching Road, #06-84 Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 10/172,327

(22) Filed: Jun. 14, 2002

(65) Prior Publication Data

US 2003/0230031 A1 Dec. 18, 2003

(51) Int. Cl.
*E04H 5/02* (2006.01)

(52) U.S. Cl. ..... 52/79.1; 52/79.8; 52/79.4; 52/33; 52/236.1

(58) Field of Classification Search ..... 52/79.1, 52/79.3–79.4, 79.6–79.8, 82, 236.1, 36.1, 52/33; 700/266, 241
See application file for complete search history.

(56) References Cited

U.S. PATENT DOCUMENTS

| | | | | | |
|---|---|---|---|---|---|
| 2,154,897 | A * | 4/1939 | Grant | 52/79.4 |
| 2,604,670 | A | 7/1952 | Horowitz et al. | |
| 3,341,428 | A | 9/1967 | Mcmanus | |
| 3,395,502 | A * | 8/1968 | Frey | 52/73 |
| 4,429,501 | A * | 2/1984 | de Brabant | 52/236.2 |
| 4,612,741 | A * | 9/1986 | Jacobson | 52/79.4 |
| 5,050,354 | A * | 9/1991 | Vendramini | 52/80.1 |
| 5,076,205 | A | 12/1991 | Vowles et al. | |
| 5,186,718 | A * | 2/1993 | Tepman et al. | 29/25.01 |
| 5,355,395 | A * | 10/1994 | Kenneth et al. | 376/216 |
| 5,632,859 | A | 5/1997 | Heitto et al. | |
| 5,795,356 | A * | 8/1998 | Leveen | 29/25.01 |
| 5,809,708 | A * | 9/1998 | Greer et al. | 52/220.7 |
| 5,860,258 | A * | 1/1999 | Faith et al. | 52/236.2 |
| 6,099,599 | A * | 8/2000 | Wu | 29/25.01 |
| 6,216,398 | B1 | 4/2001 | Shipman et al. | |
| 6,360,494 | B1 * | 3/2002 | Emerson | 52/106 |
| 6,640,878 | B2 * | 11/2003 | Allor et al. | 164/150.1 |
| 2002/0046518 | A1 | 4/2002 | Eguchi et al. | |

FOREIGN PATENT DOCUMENTS

| | | | |
|---|---|---|---|
| JP | 4-240714 | * | 8/1992 |
| JP | 11-176712 | * | 7/1999 |
| NL | 45940 | | 6/1939 |

* cited by examiner

*Primary Examiner*—Winnie Yip
(74) *Attorney, Agent, or Firm*—Horizon IP Pte. Ltd.

(57) ABSTRACT

An improved layout for a manufacturing facility is disclosed. The layout includes a hub surrounded by a production corridor. The production corridor comprises production stages used in the manufacturing process. The hub, having direct line-of-sight to the production stages, can easily monitor the manufacturing process.

7 Claims, 4 Drawing Sheets

LAYOUT OF PRODUCTION FACILITY

FIELD OF THE INVENTION

The invention relates generally to production facilities. More particularly, the invention relates to improved layouts for pharmaceutical production facilities which are compliant with current good manufacturing practices (CGMP).

BACKGROUND OF THE INVENTION

Ideally, the layout of a manufacturing facility should promote efficient flow of work and people as well as facilitating production control to minimize defects and ensure desired quality in the products manufactured. This is particularly important for the pharmaceutical manufacturing industry which operates under a strict regulatory environment. For example, in the United States, the pharmaceutical manufacturing industry must comply with "Current Good Manufacturing Practices" (CGMP) promulgated by the Food and Drug Administration (FDA). See 21 CFR §§ 210-226. Other regulations or guidelines which the pharmaceutical industry may be subjected to include, for example, World Health Organization GMP guidelines and Pharmaceutical Inspection Co-operation Scheme (PICS). CGMP defines requirements with which a drug manufacturing facility and process must comply. This includes for example, design and construction of building and facility, identifying phase of process, identifying and verifying cleaning and maintenance of equipment, location of equipment, and PICS. See Subpart C 211.42, Subpart D 211.63, Subpart F 211.182, and PICS Chapter 3.4 and 3.5.

Non-conformity with CGMP renders a drug "adulterated" under the Food, Drug and Cosmetics Act. See 21 USC § 501(a)(2)(B) (a drug is deemed adulterated "if the methods used in, or the facilities or the controls used for its manufacture, process, packing or holding do not conform to or are not operated or administered in conformity with CGMP." The purpose of 21 USC § 501(a)(2)(B) is to protect the public interest, ensuring that that drugs marketed meet the health and safety requirements as well as to satisfy quality and purity characteristics which are claimed to possess. To prevent a drug product from being deemed adulterated, a total quality control, approach and system is necessary. A failure to comply with any regulations may result in the drug being withdrawn from the market, as well as subjecting the manufacturer to sanction. This places a heavy burden on the manufacturer to ensure compliance with CGMP.

However, ambiguity in the language of the statute subjects it to interpretation and imparts uncertainty about the requirements for compliance. For example, compliance is not ensured even though the quality manufacturing process or engineering facility is considered "average" compared to the industry. This is because compliance with the regulations requires that a pharmaceutical product must be manufactured by current good manufacturing practice methods, controls and system in order to protect the public. The absence of a consistent and widely accepted interpretation of some of regulatory requirements has led to increased cost in engineering new facilities. This has also led to longer lead-times and, in some cases, delays in bringing new pharmaceutical products to market. In an attempt to clarify the regulatory requirements, the International Society for Pharmaceutical Engineering and the FDA have cooperated to publish a Baselines Pharmaceutical Engineering Guide (Guide).

The Guide includes suggestions from the FDA for compliance with CGMP. The main basic philosophy promoted by the Guide is "Good Engineering Practice" (GEP), which is defined as "established engineering methods and standards that are applied throughout the project life cycle deliver appropriate, cost effective solutions". It takes into account the design and installation of facilities and equipment and takes "full account of CGMP, safety, health, environmental, ergonomic, operational, maintenance, recognized industry guidance, and statutory requirements". See Guide.

FIG. 1 shows a layout of a conventional pharmaceutical manufacturing flicility 101. As shown, the facility comprises a rectangular shaped building with two levels 103*a* and 103*b*. Typically, the production area 140 is located on the ground level 103*a* while non-production areas are located on die second level 103*b*. Also located on the ground level are storage area 195; and packing area 197. Additional areas, such as changing area 194, cafeteria 191, engineering area 193 can also be included on the ground level. The non-production areas on the second level include administration area 108, laboratory area 141, storage area 145, and HVAC plant room 146. In sonic facilities, all the different areas are provided in a single level.

The various production suites 165 form different stages of a production line for manufacturing pharmaceutical products. Products are tested from the various stages for quality control. The finished products are transferred to the packing area for packaging and then to the storage area.

Although such a layout may comply with CGMP, it is, however, inefficient. For example, quality assurance and quality control cannot be easily and effectively carried out in conventional layouts. The different production stages are not visible from a single point, making it inconvenient to monitor, identify, and verify the manufacturing process. Furthermore, testing of drugs for different stages is inconvenient since the laboratory is not located nearby to provide easy access. These deficiencies increase process time. Therefore, a manufacturer incurs additional costs to ensure that the process can be monitored adequately for verification and quality control, rendering such layouts not cost effective.

From the foregoing discussion, it is desirable to provide a more efficient and cost effective layout for a manufacturing facility.

SUMMARY OF THE INVENTION

The invention relates to an improved layout for a manufacturing facility. In one embodiment, layout includes a hub surrounded by a production corridor comprising a plurality of production stages. The production stages are visible from the hub, enabling the manufacturing process to be monitored therefrom. In another embodiment, a facility corridor surrounds the production corridor. The facility corridor can be used for servicing and maintaining the production equipment, such as through-the-wall technology type equipment. The facility corridor can also serve to facilitate testing of products from the production stages and/or cleaning and maintenance of production equipment. Additionally, the facility corridor can also serve as a buffer zone to reduce the influence of external building conditions on the production corridor. In another embodiment, the production and non-production areas are separated into two separate buildings. The two buildings can be interconnected by enclosed linkways or passageways, forming a satellite configuration. Additional production capacity can be obtained by adding additional production buildings. The additional buildings can be interconnected to either the production or non-production building or a combination of both.

In accordance with various embodiments of the invention, the layout is designed to comply with GMP as well as other regulatory and quality requirements. The layout facilitates production and cleaning processes, and movement of people and products. Furthermore, the layout enables the phase of processing to be easily and cost-effectively monitored, identified and verified for greater efficiency in records, quality process control, quality assurance and regulatory compliance with CGMP.

DETAILED DESCRIPTION OF THE INVENTION

Figure 1:
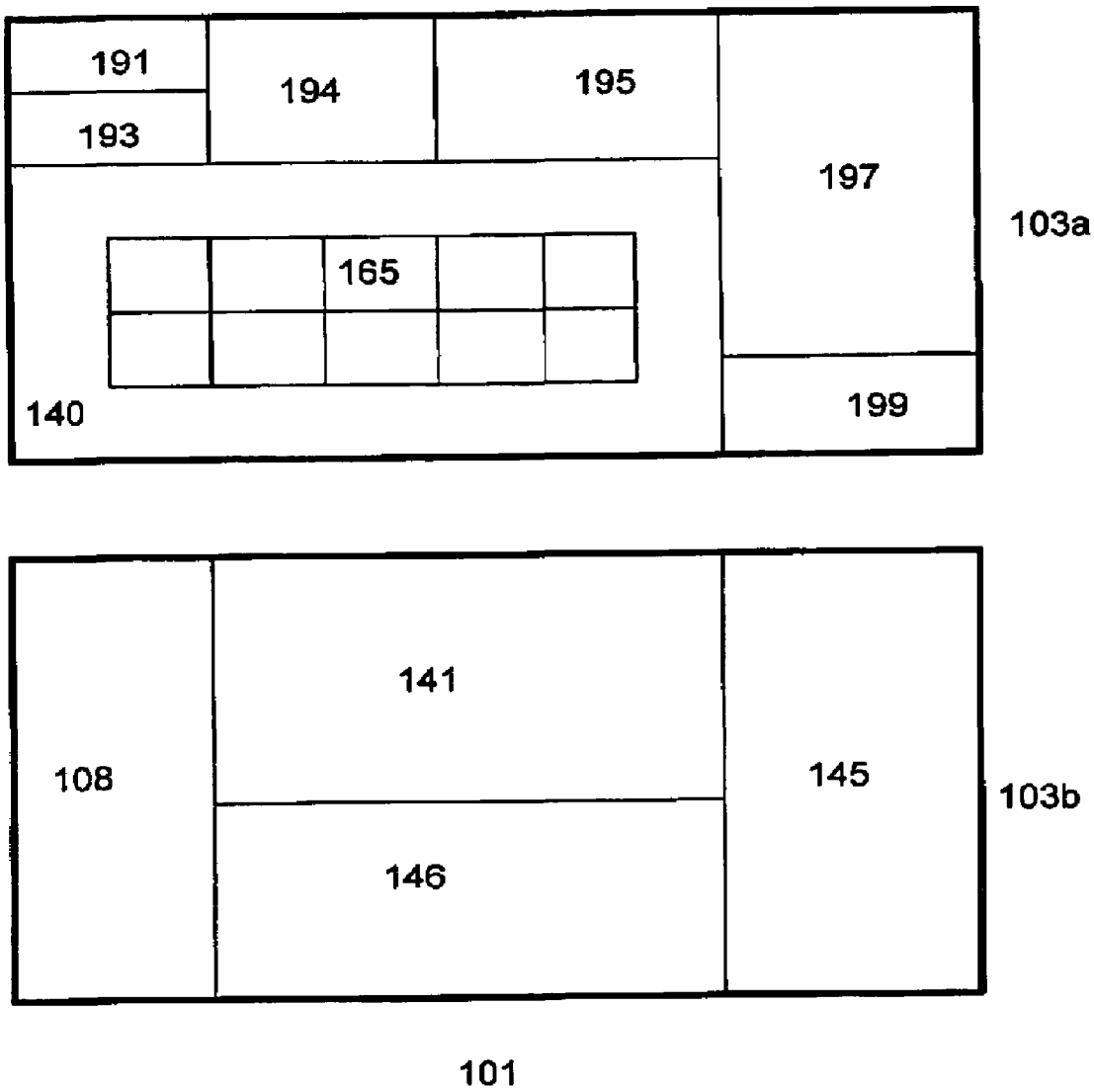
Fig. 1 Prior Art
FIG. 1 shows a conventional layout of a production facility.
Figure 2:
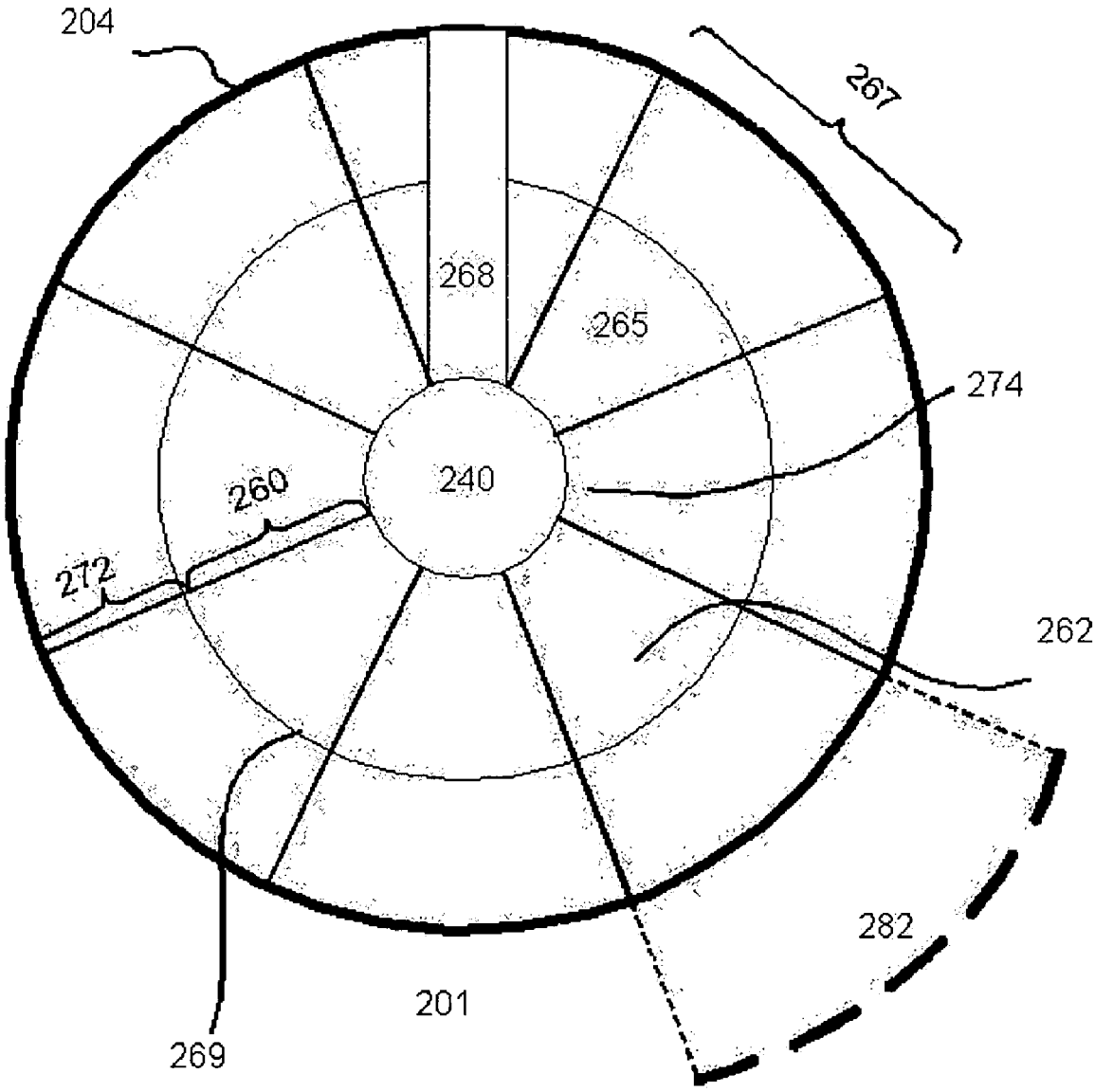
FIGS. 2-4 show layouts of production facilities in accordance with various embodiments of the invention.

FIG. 2 shows a building 201 of a production facility in accordance with one embodiment of the invention. Illustratively, the facility is depicted having a circular shape 204. Other shapes, such as oval, triangular, square, or other types of polygon, can also be useful. In accordance with the invention, the layout of the production facility includes a production corridor 260 surrounding a hub 240. The shapes of the production corridor and hub, for example, are consistent with the shape of the building. It is, however, understood that it is not necessary that the building, hub, and production corridor have the same shape. For example, the hub can be rectangular, while the building and production corridor are circular or other polygonal shapes.

The production corridor comprises a plurality of processing stages 265 used in manufacturing one or more products. A processing stage is used top one or more steps in the manufacturing process. For example, stages are used to perform front-end and back-end processes. The processing stages can form one or more production lines used to form one or more products. Some stages, for example, can be duplicated. The sequence of the production stages can be arranged to optimize the production process. In one embodiment, the stages are arranged to facilitate flow of work from stage to stage, to the extent possible, in a clockwise or counter clockwise direction.

In one embodiment, the production stages are used to manufacture pharmaceutical products. Various types of production stages for manufacturing pharmaceutical products include, for example, dispensing, mixing, coating, capsule filling and tableting. Also, the production corridor can include a staging area 262. The staging area, for example, serves as a temporary or intermediate storage and staging of equipment. A storage area for temporary or intermediate storage of materials and finished products can also be provided.

To reduce or avoid contamination of materials due to servicing or maintenance of equipment used in the manufacturing process, through-the-wall equipment is used. Such types of equipment are designed to be serviced through a wall outside the production stages. For example, the equipment is located, for example, against a wall 269. Servicing of the equipment would then be conducted in a facility corridor 272 through an opening in the wall.

In one embodiment, a test lab is provided in the facility corridor for testing of the products from the different stages. An opening can be provided in the wall through which products from the different stages are passed from the production stages to the facility corridor. The opening can also serve to pass tested products back to the production stages. The opening can be designed to maintain the controlled environment of the production corridor. For example, the opening can be designed with an air-lock mechanism. The opening can also serve to pass other components of the production stages. For example, equipment which needs to be cleaned can be passed through the opening. Preferably, each production stage is provided with a passageway for convenience. The products are then transferred to the test laboratory for testing.

The production corridor can be enclosed in an environmentally controlled area to maintain, for example, temperature, humidity, and air quality of the production corridor within desired limits. For applications where air quality is important, it is useful to minimize or reduce flow of people or materials in and out of the production corridor. Preferably, the hub is physically separated from the production corridor. An access way 268 is provided to facilitate access to the hub without entering the production corridor. Additionally, the facility corridor can also be outside of the environmentally controlled production corridor.

In one embodiment, the production corridor is segmented into subsegments 267. A subsegment can comprise one or more production stages. In one embodiment, the subsegments are physically separated by barriers. The barriers can extend the full width of the production corridor, forming separate production stages. In one embodiment, the barriers also extend into the servicing corridor. Providing barriers which do not extend into the servicing corridor is also useful. Accesses, such as doors, can be provided in the barriers to facilitate flow of people, materials, or products from subsegment to subsegment. In an alternative embodiment, the barriers do not extend the full width of the production corridor, leaving an access path between subsegments. In such applications, the production stages can be completely enclosed, (e.g., production suites) having doors for access from the access path. Providing production stages which are not completely enclosed is also useful. Alternatively, the hub can serve as a passageway between the different production stages.

Segmenting the production corridor adds flexibility to the production facility. For example, a subsegment can be upgraded individually without impacting the other segments. Furthermore, a segment can be expanded individually to increase its capacity by extending the barriers and outer wall of the building, as shown by the dotted line 282

In accordance with one embodiment of the invention, the production stages are visible from the hub (i.e., a direct line-of-sight from the hub). If the hub is physically separated from the production corridor, the barrier 274 used to separate the hub from the corridor should be at least partially transparent to allow the production stages to be visible from within the hub. The hub serves as a control area, enabling the manufacturing process to be monitored, identified, and verified easily and efficiently therefrom. In one embodiment, manufacturing data from the processing stages are transferred to the hub. This can be performed in real time or after each process is completed. For example, communication links are provided to one, some, or all the production stages. Manufacturing information is transferred via the communication links to the hub.

In another embodiment, the hub comprises at least first and second levels. In one embodiment, a laboratory is provided for testing of the products at various stages of production. Other functions can also be included. The laboratory may be located on the same level as the production stages. Providing the laboratory at the center allows convenient access from the production stages, increasing manufacturing efficiency. Typically, the laboratory can be part of the same controlled environment as the production facility. Barriers can be provided, if necessary, to avoid commingling with the production area. The control area is preferably located above the laboratory. This allows the control area to have a direct line-of-sight to the production floor below. Additional levels can be provided in the hub to house other areas of the manufacturing facility. For example, dispensing, mixing, cleaning, or engineering activities. Alternatively, the other areas can be integrated into a single level with the control or monitoring areas.

A buffer zone can optionally be located between the outer wall of the building and the production corridor. The buffer zone is particularly useful for applications in which the changes in the production environment can easily impact yields. The buffer zone serves to provide additional insulation between the internal production environment and external building conditions. Where the facility corridor is outside of the environmental controlled production corridor, it can also serve as the buffer zone. It also serves as an additional barrier against the entry of insets or other contaminants which can adulterate the products.

Figure 3:
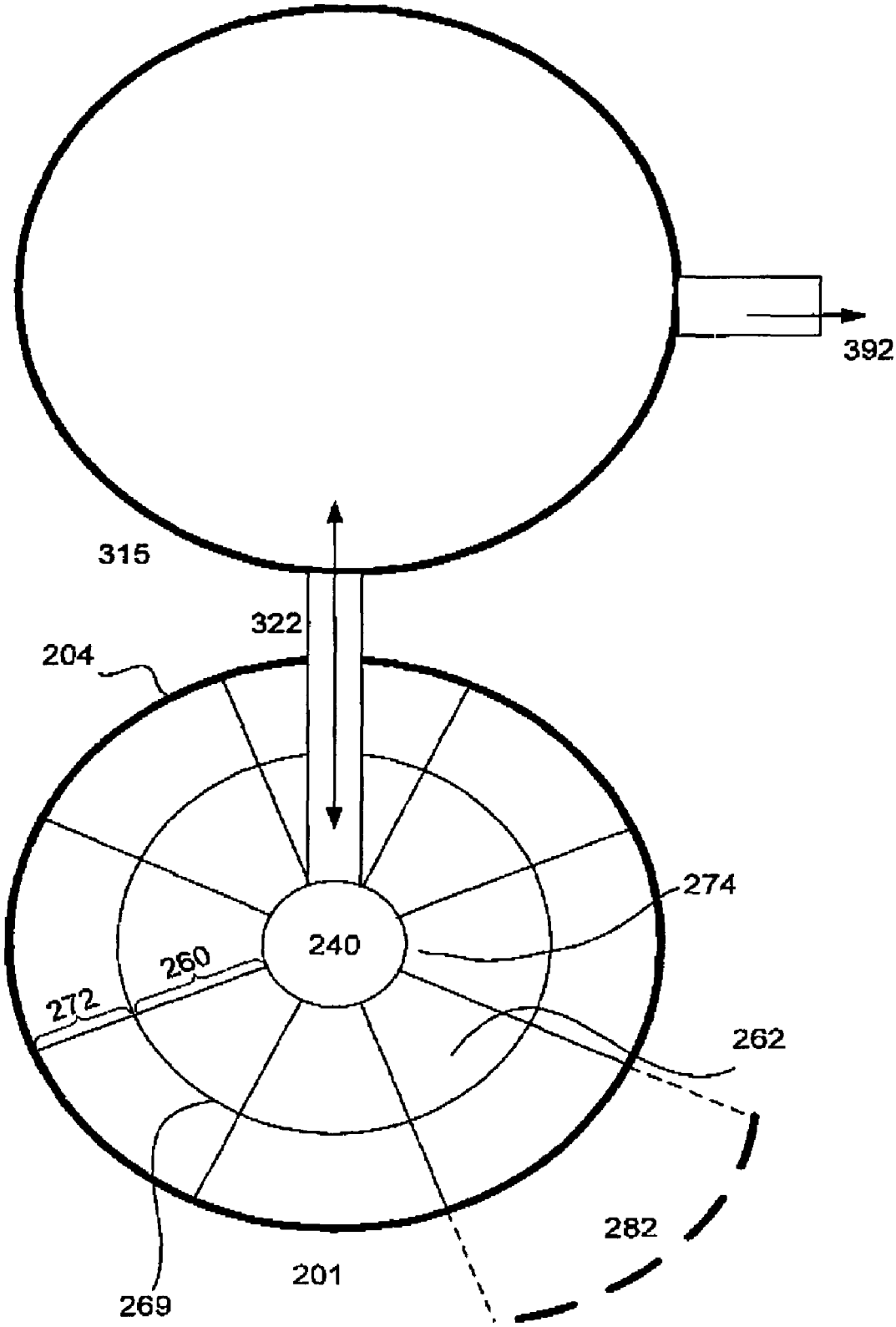

In accordance with one embodiment of the invention, the non-production area is located in a second building 315, as shown in FIG. 3. Preferably, the second building and the production building are interconnected by enclosed link-way or passageway 322. Providing non-interconnected buildings is also useful. The non-production area comprises, for example, area for, chemical or supply storage, equipment maintenance, office and administration, meeting rooms, test and/or analysis laboratory, and locker (changing) room. Other non-production functions, such as a cafeteria, can also be included.

In one embodiment, the non-production building 315 comprises at least first and second levels. The first level comprises, for example, maintenance, storage, delivery and reception areas. The storage area can include first and second areas, one for storing raw materials and other for finished products. The second level can include, for example, cafeteria, administration, office, and training areas. Providing the storage area in the first level (e.g., same level as production floor) facilitate flow of materials or products to and from the production corridor, as shown by the arrows. Such a design also gives flexibility for expansion. For example, production capacity can be increased by adding additional production facilities (e.g., similar to building 201) via, for example, link-way 392, as needed. The additional production facilities can be interconnected to the non-production building 315, creating a satellite production arrangement. Alternatively, the additional production facilities can be interconnected to other production facilities or a combination thereof. The buildings can be configured (e.g., sizes, interconnections, etc.), can be designed to optimize the use of available land area.

The layout, as described, provides an efficient process flow. For example, work flows along the production corridor while product testing and flow of information are toward the center to the hub area 240. Furthermore, since the hub has a direct line-of-sight and access to manufacturing data, the layout enables easy monitoring of the manufacturing process, effectively assuring that the flow of materials, people, products are efficient, correct, and verified. The layout also minimizes the number people going through the production corridor (e.g., people can view the production area from the hub without having to enter the production area), facilitating control of the production environment (e.g., temperature, dust, and humidity) and to prevent contamination. This facilitates control of the production environment. Such advantages reduce manufacturing costs by increasing efficiency and reducing errors while being compliant with CGMP.

In an alternative embodiment, the non-production area can be located in the same building as the production area. The non-production area can be provided as a concentric area outside the production corridor. Alternatively, the non-production area is provided in an area adjacent to only a part of the production corridor.

Figure 4:
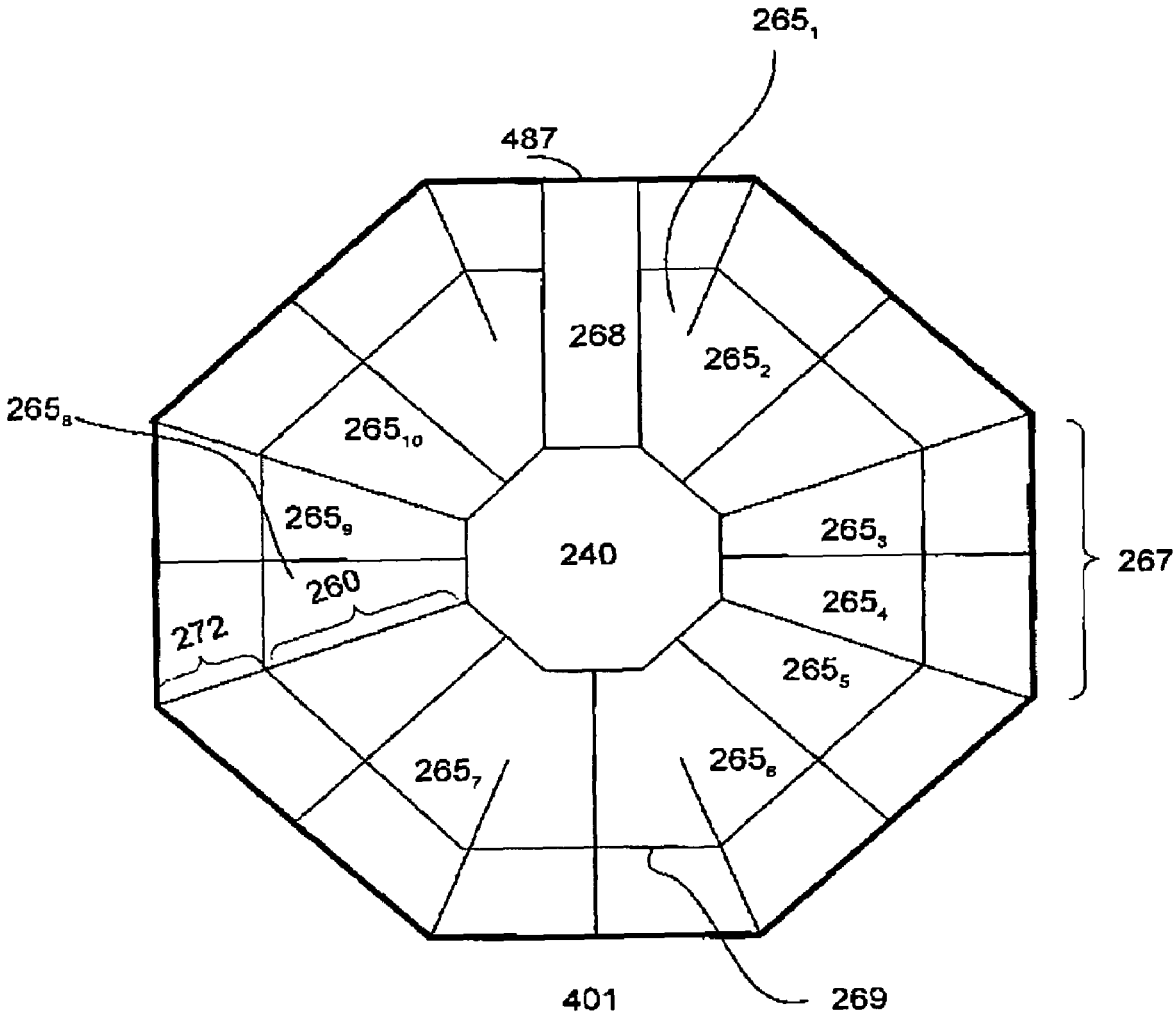

FIG. 4 shows another embodiment of the invention. As shown, a building 401 is provided which encloses the production area. In one embodiment, the shape of the building is a polygonal. Preferably, the shape of the building is an octagon. A production corridor 260 surrounds a hub 240. The production corridor and hub preferably are octagons. Providing a production corridor and a hub which have different shapes are also useful. The production corridor comprises a plurality of production stages 265. The production corridor is enclosed in an environmentally controlled space to maintain, for example, air quality, temperature, and humidity within desired limits.

The production corridor can be segmented into subsegments 267. In one embodiment, a subsegment is equal to one side of the polygon. In the case of an octagon, the production corridor comprises 8 subsegments. A subsegment can include one or more production stages. Also, a production stage can overlap into an adjacent subsegment. A segment can be separated by a barrier. The barrier can extend the full width of the production corridor. Accesses can be provided to facilitate flow of materials, products, and people for segment to segment. Alternatively, the barrier extends partially the width of the production corridor. In another alternative embodiment, barriers which separate different production stages extend the full width of the production corridor.

In one embodiment, the production stages are used to manufacture pharmaceutical products, such as drugs. The production stages include, for example, dispensing, granulator mixing, drying, tableting, tablet coating, IBC blending, and packaging stages. Other stages, such as utility, or storage, can also be included in the production corridor. Preferably, the stages are arranged to optimize the efficiency of the manufacturing process (e.g., flow of materials, products, and people). In one embodiment, the front-end stages are located toward a first end of the production corridor while the back end stages are located in the other end. Preferably, the first end begins near the entrance of the production corridor.

In one embodiment, the first stage $\mathbf{265}_1$ of the production located by an entrance 487 serves as a utility area. A dispensing and sieving stage $\mathbf{265}_2$, large granulator mixing stage $\mathbf{265}_3$, fluidised-bed drying stage $\mathbf{265}_4$, small granulator mixing stage $\mathbf{265}_5$, tableting stage $\mathbf{265}_6$, table-coating stage, IBC blending stage $\mathbf{265}_7$, capsule filling stage $\mathbf{265}_8$, and packaging stage $\mathbf{265}_9$ are sequentially providing in the production corridor. Providing other type of stages or in other sequences is also useful. Preferably, the various types of equipment used are serviced from behind a wall 269 outside the production stage. A service corridor 272 is provided to service the equipment. The service corridor preferably is not part of the controlled environment of the production corridor, enabling it to also serve as a buffer zone.

In one embodiment, the hub comprises first and second levels. The first level comprises, for example, a laboratory for testing products at various stages of production. The first level may be on the same level as the production stages. Providing the laboratory at the center of the production stages enables efficient testing of products at different stages of production.

The second level of the hub comprises a control center for monitoring the production process. In a preferred embodiment, the second level is above the production stages. Manufacturing data from the processing stages are transferred to the hub via, for example, communication links. Administration or non-production functions are located in a second building (not shown).

As described, the present invention provides an efficient layout for manufacturing facility which complies with CGMP. Internally, the manufacturing facility includes a hub surrounding by a production corridor having a plurality of production stages used in the manufacturing process. The hub serves as a control, assurance and management area for production. Due to the fact that the production phases are directly visible from the hub, the manufacturing process can easily be monitored, identified and verified therefrom. The Hub functions like a "cockpit" of the process information data control center, which has the ability to directly view the process at will. A facility corridor can be provided around the production corridor. Activities such as quality testing, maintenance and cleaning can be conducted in the facility corridor. Additionally, non-production areas can be provided in the facility corridor or surrounding the facility corridor.

In accordance with the invention, the layout allows fast access of quality control and cleaning activities to the production process and enabling a highly integrated operational environment for compliance and effectiveness. The facility corridor efficiently utilizes space and provides flexibility to implement "behind-the-wall" or "through-the-wall" equipment arrangement for better control of environment. In addition, the facility corridor could also act as a buffer to better control external weather and climatic changes.

Externally, the production and the non-production sections are separated into separate buildings in accordance with one embodiment of the invention. Additional production buildings can also be provided. Preferably, the production and non-production buildings are joined by one or more link-ways. The functional use, size proportions, dimension, floor levels and the location of the two buildings and the link-way can be modified for particular applications. The separation of the non-production and the production areas into separate buildings facilitates better management and control of environmental parameters, people and product flow. The separate buildings, for example, form a satellite configuration to provide the complete operations of a company. A series of link-ways can join various buildings in different configurations.

By providing independent buildings (e.g., satellites), each can have their own management and control of environmental parameters, and work and people flow, according to their individual needs and priority. Furthermore, increased flexibility results through the use of satellite configuration, enabling modular or segmental retrofitting, upgrading and renovation of each building or sections of each building.

While the invention has been particularly shown and described with reference to various embodiments, it will be recognized by those skilled in the art that modifications and changes may be made to the present invention without departing from the spirit and scope thereof. The scope of the invention should therefore be determined not with reference to the above description but with reference to the appended claims along with their full scope of equivalents.

What is claimed is:

1. A layout for an enclosed manufacturing facility comprising:

an enclosed structure including a hub located in a central portion of the enclosed structure, the hub serving as a control center for processing and for monitoring processing;

a production area for carrying out manufacturing processes, the production area surrounds the hub, the production area includes a plurality of production stages, the production stages of the production area are enclosed in a common controlled production environment;

a first barrier physically separating the hub from the controlled production environment of the production area, wherein at least a portion of the barrier is transparent to sufficiently enable personnel in the hub to visually monitor the manufacturing processes in the production area without interrupting the controlled production environment; and a support area within the enclosed structure, the support area surrounds the production area and being physically separated from the controlled production environment of the production area by a second barrier.

2. The layout of claim 1 wherein the production stages of the production area are adapted to produce at least one pharmaceutical product.

3. The layout of claim 1 wherein the hub facilitates collection and storing of processing data from the production stages of the production area.

4. A layout for an enclosed manufacturing facility comprising:

an enclosed structure including a hub disposed in the enclosed structure;

a production area including a plurality of production stages substantially surrounding the hub, wherein at least one of the production stages comprises production equipment associated with a manufacturing process, the production area enclosed in a controlled production environment, a first barrier physically separating the hub from the controlled production environment of the production area, wherein at least a portion of the barrier is transparent to sufficiently enable personnel in the hub to visually monitor the manufacturing process in the production area without interrupting the controlled production environment, and a facility area within the enclosed structure and surrounding the production area which is physically separated by a second barrier to isolate the facility area from the controlled environment of the production area, the facility area supports the manufacturing process from outside the production area.

5. The layout of claim 1 wherein the support area serves to facilitate cleaning of equipment in the production stages of the production area.

6. The layout of claim 2 wherein the support area serves to facilitate cleaning of equipment in the production stages of the production area.

7. The layout of claim 3 wherein the support area serves to facilitate cleaning of equipment in the production stages of the production area.

* * * * *